US005876523A

United States Patent [19]

Nagayoshi et al.

[11] Patent Number: 5,876,523

[45] Date of Patent: Mar. 2, 1999

[54] METHOD OF PRODUCING SPHEROIDAL GRAPHITE CAST IRON ARTICLE

[75] Inventors: Hideaki Nagayoshi; Seishin Ueda; Kouhei Imanishi, all of Fukuoka-ken, Japan

[73] Assignee: Hitachi Metals, Ltd., Tokyo, Japan

[21] Appl. No.: 848,022

[22] Filed: Apr. 28, 1997

[30] Foreign Application Priority Data

Apr. 29, 1996 [JP] Japan ..... 8-132818

[51] Int. Cl.[6] ..... C21D 5/00

[52] U.S. Cl. ..... 148/614; 148/618; 148/902

[58] Field of Search ..... 148/614, 618, 148/902

[56] References Cited

U.S. PATENT DOCUMENTS 4,990,194 2/1991 Obata et al. .
5,346,561 9/1994 Obata et al. .

FOREIGN PATENT DOCUMENTS 6-200322 7/1994 Japan .

*Primary Examiner*—Deborah Yee

*Attorney, Agent, or Firm*—Sughrue, Mion, Zinn, Macpeak & Seas, PLLC

[57] ABSTRACT

A method of producing a spheroidal graphite cast iron article containing at least one pearlite stabilizing element selected from the group consisting of Mn, Cu, Sn, Sb and Pb and having a double layer structure which comprises a surface layer portion and an inner portion. The surface layer portion has a matrix 60% or more of which is ferrite phase and a thickness of at least 0.5 mm. The inner portion has a matrix substantially comprising pearlite phase. The method comprises: (1) heat-treating a starting spheroidal graphite cast iron at a temperature which transforms a whole part of a matrix of the starting spheroidal graphite cast iron substantially to austenite phase; (2) slowly cooling the austenitized spheroidal graphite cast iron at a cooling rate (5° to 20° C./min) which allows in a subsequent step the surface layer portion to be ferritized before the inner portion starts to be pearlitized; (3) holding the cooled spheroidal graphite cast iron at a temperature (710° to 770° C.) which allows the surface layer portion to be first ferritized and subsequently allows the inner portion to be pearlitized while preventing the ferrite phase of the surface layer portion from being transformed to another; and (4) cooling the spheroidal graphite cast iron thus transformed immediately after completion of the pearlitization of the inner portion.

8 Claims, 10 Drawing Sheets

F FERRITE PHASE
P PEARLITE PHASE
γ AUSTENITE PHASE

F FERRITE PHASE
P PEARLITE PHASE
γ AUSTENITE PHASE

METHOD OF PRODUCING SPHEROIDAL GRAPHITE CAST IRON ARTICLE

BACKGROUND OF THE INVENTION

The present invention relates to a method of producing a spheroidal graphite cast iron article excellent in bending characteristics and mechanical strength such as impact strength.

Since spheroidal graphite cast iron has an excellent mechanical strength and castability, it is widely used in various applications including automobile parts, machine parts, etc. Specifically, spheroidal graphite cast iron species of FCD 700 and FCD 800 in JIS G5502 are used for parts requiring a high mechanical strength, and spheroidal graphite cast iron species of FCD 370 and FCD 400 in JIS G5502 are used for parts requiring a large elongation. Further, since important parts of automobiles such as suspension parts are required to have good properties in tensile strength, elongation, fatigue resistance, impact strength, etc., the spheroidal graphite cast iron constituting such important parts should satisfy the above strength requirements. However, the as-cast surface of the spheroidal graphite cast iron has some unevenness due to sand inclusion and slag inclusion, and such an unevenness is likely to function as starting points of cracking and failure. Therefore, the spheroidal graphite cast iron having an as-cast surface fails to exhibit its inherent mechanical strength sufficiently.

In such circumstances, one of the inventors has previously proposed in U.S. Pat. No. 4,990,194 a thin spheroidal graphite cast iron article having a good mechanical strength, which has graphite particles dispersed in a ferrite matrix containing 10% or less of pearlite by volume fraction, and is characterized in that there is substantially no fine gap between the graphite particles and the ferrite matrix. Such a thin high-strength article of spheroidal graphite cast iron can be produced by pouring a melt having a spheroidal graphite cast iron composition into a casting mold; removing the casting mold by shake-out after the completion of solidification of the melt, while substantially the entire portion of the resulting cast iron product is still at a temperature of its $A_3$ transformation point or higher; introducing the cast iron product into a soaking zone of a continuous furnace kept at a temperature of the $A_3$ transformation point or higher, where the cast iron product is kept for 30 minutes or less to decompose cementite contained in the matrix; and transferring the cast iron product into a cooling zone of the continuous furnace to cool the cast iron product at such a cooling speed as to conduct the ferritization of the matrix.

However, unlike in the case of the thin articles of spheroidal graphite cast iron, spheroidal graphite cast iron articles having relatively large thickness, at least about 10 mm thickness for example, for use in parts which should satisfy higher mechanical strength requirements should retain a pearlite phase to show a good mechanical strength and at the same time should exhibit improved bending characteristics. For this purpose, the heat treatment of ferritizing the spheroidal graphite cast iron entirely or mostly is not satisfactory.

To solve this problem, one of the inventors has previously proposed in U.S. Pat. No. 5,346,561 a spheroidal graphite cast iron article which has a surface layer portion mostly composed of a ferrite phase and having a thickness of at least 1 mm, and an inner portion composed of a pearlite phase and a ferrite phase, the surface layer portion having a ferritization ratio of 70% or more which is larger than that of the inner portion by at least about 15%.

Such a spheroidal graphite cast iron article can be produced by the steps of (a) pouring a melt having the same composition as that of a spheroidal graphite cast iron to be produced into a casting mold; (b) removing the casting mold by shake-out after the completion of solidification of the melt, while substantially the entire portion of the resulting cast iron product is still at a temperature of its Al transformation point or higher; (c) when the temperature difference between the surface layer portion and the inner portion has become 40° to 60° C., introducing the cast iron product into a soaking furnace kept at a temperature of 750° to 900° C., where the cast iron product is held for such a period of time as to produce the surface layer portion having a ferritization ratio of 70% or more which is larger than that of the inner portion by at least about 15%; and (d) transferring the cast iron product into a cooling furnace to cool the cast iron product at a cooling speed of 15° to 100° C./min.

Another method of producing such a spheroidal graphite cast iron article comprises the steps of (a) introducing a pearlitized spheroidal graphite cast iron product into a soaking furnace kept at a temperature of 780° to 870° C., where the cast iron product is held for such a period of time as to produce the surface layer portion having a ferritization ratio of 70% or more which is larger than that of the inner portion by at least about 15%; and (b) transferring the cast iron product into a cooling furnace to cool the cast iron product at a cooling speed of 15° to 100° C./min.

Although the spheroidal graphite cast iron articles produced by the above methods have good bending characteristics and a high mechanical strength, both the methods involve the steps difficult to be strictly controlled. More specifically, in the first method, a cast iron product after the shake-out is introduced into the soaking furnace kept at 750° to 900° C. when the temperature difference between the surface layer portion and the inner portion reaches 40° to 60° C. However, it is very difficult to determine the timing for introducing the cast iron product to the soaking furnace. In the second method where a pearlitized spheroidal graphite cast iron product is subjected to ferritization in the soaking furnace kept at 780° to 870° C., the holding time in the soaking furnace for reaching a intended ferritization ratio is difficult to be suitably controlled.

OBJECT AND SUMMARY OF THE INVENTION

Accordingly, an object of the present invention is to provide a method of producing a spheroidal graphite cast iron article having excellent bending characteristics and a high mechanical strength such as impact strength.

As a result of the intense research in view of the above objects, the inventors have found that a spheroidal graphite cast iron containing a pearlite stabilizing element acquires a double layer structure of matrix when slowly cooled from an austenitizing temperature at a controlled cooling range and then held at a specified temperature where the matrix of surface layer is first ferritized and then the matrix of inner portion is pearlitized, and that such a spheroidal graphite cast iron having the double layer structure has improved bending characteristics and impact strength. The present invention has been accomplished based on the above findings.

Thus, in an aspect of the present invention, there is provided a method of producing a spheroidal graphite cast iron article containing at least one pearlite stabilizing element selected from the group consisting of Mn, Cu, Sn, Sb and Pb and having a double layer structure which comprises a surface layer portion and an inner portion, the surface layer portion having a matrix having a ferritization ratio of 60% or more and a thickness of at least 0.5 mm and the inner portion having a matrix substantially comprising pearlite phase, which method comprises: (1) heat-treating a starting spheroidal graphite cast iron at a temperature which transforms an entire portion of a matrix of the starting spheroidal graphite cast iron substantially to austenite phase; (2) slowly cooling the austenitized spheroidal graphite cast iron at a cooling rate which allows in a subsequent step the surface layer portion to be ferritized before the inner portion starts to be pearlitized; (3) holding the cooled spheroidal graphite cast iron at a temperature which allows the surface layer portion to be first ferritized and subsequently allows the inner portion to be pearlitized while preventing the ferrite phase of the surface layer portion from being transformed to the other phases; and (4) cooling the spheroidal graphite cast iron thus transformed immediately after completion of the pearlitization of the inner portion.

DETAILED DESCRIPTION OF THE INVENTION

[1] Spheroidal graphite cast iron article

[1-A] Composition

Figure 1:
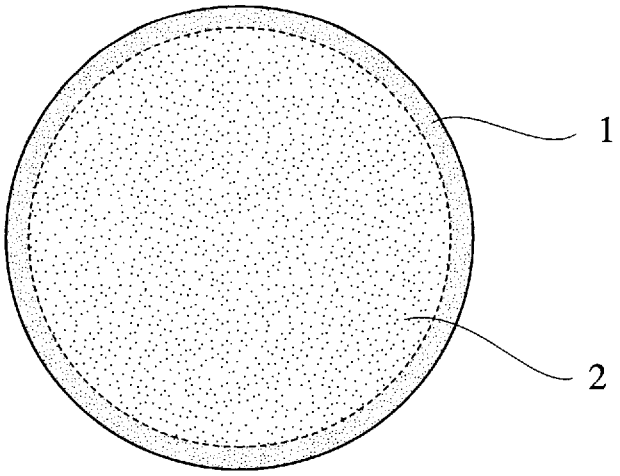
FIG. 1 is a sectional view schematically showing the double layer structure of a spheroidal graphite cast iron article produced by the method of the present invention.

The spheroidal graphite cast iron article to be treated by the production method of the present invention generally has the following chemical composition, each expressed by weight percent based on the amount of the spheroidal graphite cast iron article:

C: 3.4 to 3.9%,

Si: 1.9 to 2.6%,

P: 0.05% or less,

S: 0.02% or less,

Mg: 0.02 to 0.06% or less,

Pearlite stabilizing element: 0.001 to 0.8%, and

Fe and inevitable impurities: balance.

(1) C: 3.4 to 3.9 weight %, preferably 3.5 to 3.8 weight %.

When the amount of C is less than 3.4 weight % or more than 3.9 weight %, the castability of the spheroidal graphite cast iron is reduced.

(2) Si: 1.9 to 2.6 weight %, preferably 2.0 to 2.4 weight %.

When the amount of Si is less than 1.9 weight %, there is a large tendency of forming carbides. On the other hand, when the amount of Si exceeds 2.6 weight %, it is difficult to control the amount of pearlite phase, failing to produce a uniform pearlitic structure in the inner portion.

(3) P:0.05 weight % or less, preferably 0.03 weight % or less (excluding zero).

P is an element of hindering the spheroidization of cast iron. Accordingly, the amount of P should not exceed 0.05 weight %.

(4) S: 0.02 weight % or less, preferably 0.015 weight % or less (excluding zero).

S is an element of hindering the spheroidization of cast iron. Accordingly, the amount of S should not exceed 0.02 weight %.

(5) Mg: 0.02 to 0.06 weight %, preferably 0.02 to 0.05 weight %.

When the amount of Mg is less than 0.02 weight %, the yield of forming the spheroidal graphite cast iron is reduced. On the other hand, when the amount of Mg exceeds 0.06 weight %, chill phase is likely to be generated.

(6) Pearlite stabilizing element: 0.001 to 0.8 weight %.

The pearlite stabilizing element is at least one element selected from the group consisting of Mn, Cu, Sn, Sb and Pb, and preferably Cu alone or in combination with Mn. When the total amount of the pearlite stabilizing elements is less than 0.001 weight %, the stabilizing effect is not obtained. On the other hand, an amount exceeding 0.8 weight % makes the formation of the double layer structure difficult.

The total amount of the pearlite stabilizing elements is preferably 0.001 to 0.6 weight %, more preferably 0.3 to 0.5 weight %.

In particular, the amount of Cu is preferably 0.3 to 0.5 weight %, and preferably 0.3 to 0.4 weight % for Mn. The amount of each of Sn, Sb and Pb is preferred to be 0.001 to 0.03 weight %.

(7) Other elements

In addition to the above essential elements, the spheroidal graphite cast iron article to be treated in the present invention may further contain Cr, Ca, Bi, rare earth elements, etc. In particular, Cr can improve the corrosion resistance, and may be contained in an amount of 3 weight % or less. Ca, Bi and rare earth elements make the graphite particles finely dispersed, and each may be contained in an amount of 0.1 weight % or less.

[1-B] Double layer structure

As shown in FIG. 1, the spheroidal graphite cast iron article produced by the method of the present invention has a double layer structure comprising a surface layer portion 1 (rim) having a relatively low hardness and a inner portion 2 having a high mechanical strength.

(1) Surface layer portion

The metal structure of the surface layer portion 1 should have a ferritization ratio of 60% or more. Here, the term "ferritization ratio" means an volume fraction of a ferrite phase in the matrix, which is obtained by image-processing an image (about×400) of metal structure under a microscope by using an image-processing apparatus (Quantimet 920 Image Analyzer, trade mark, manufactured by Cambridge Instruments, Co.). "pearlitization ratio" and "austenitization ratio" (which may be measured as martensite ratio) described below are also defined and determined in the same manner as in the ferritization ratio. When the ferritization ratio is less than 60%, the surface layer portion 1 does not have a sufficiently reduced hardness, failing to exhibit sufficient effect of preventing the cracking and failure. The ferritization ratio is preferably 70% or more, and more preferably 80% or more. The remaining phase in the matrix of the surface layer portion 1 is substantially pearlite phase.

The surface layer portion 1 has a Vickers hardness (Hv) less than 300. When the Vickers hardness is 300 or more, it is likely that the surface unevenness (small projections and recesses) of the spheroidal graphite cast iron article may function as the starting points of cracking and breakage.

The thickness of the surface layer portion 1 is at least 0.5 mm, preferably at least 1 mm. When the thickness is less than 0.5 mm, a sufficient effect of preventing the cracking and breakage cannot be achieved. The upper limit of the thickness of the surface layer portion 1 depends on the total thickness or the outer diameter of the spheroidal graphite cast iron article, and is generally 30% or less of the total thickness or the outer diameter. If the thickness of the surface layer portion 1 exceeds 30% of the total thickness or the outer diameter, the spheroidal graphite cast iron article would show a reduced mechanical strength.

(2) Inner portion

The metal structure of the inner portion 2 mostly comprises pearlite phase, i.e., has a pearlitization ratio of 50% or more, preferably 60% or more, and more preferably 70% or more. When the pearlitization ratio is less than 50%, the spheroidal graphite cast iron article would show a reduced mechanical strength. The remaining phase of the matrix of the inner portion 2 is substantially ferrite phase.

Because of the above structure, the inner portion 2 shows a Vickers hardness Hv higher than that of the surface layer portion 1. In general, the Vickers hardness Hv of the inner portion 2 is preferred to be higher than that of the surface layer portion 1 by about 100.

Since the spheroidal graphite cast iron article having the above double layer structure has a surface layer portion 1 having a thickness of at least 0.5 mm, the total thickness or the outer diameter of the spheroidal graphite cast iron article is required to be relatively large to produce the effect of the present invention. The total thickness or the outer diameter is preferably 12 mm or more, more preferably 15 mm or more, and usually 30 mm or less to obtain a good effect of the present invention.

[2] Method of producing spheroidal graphite cast iron article

The method for producing the spheroidal graphite cast iron article having the above double layer structure comprises successively subjecting a starting spheroidal graphite cast iron to (1) austenitizing heat treatment, (2) slow cooling, (3) isothermal transformation (ferritization of the surface layer portion 1 and subsequent pearlitization of the inner portion 2), and (4) cooling. The starting spheroidal graphite cast iron to be heat-treated in the present invention is not specifically limited as far as it has the above alloying composition. The method of the present invention will be explained in detail referring to FIG. 2.

(1) Austenitizing heat treatment

The starting spheroidal graphite cast iron is heated and held at 800° to 1,000° C., preferably 850 to 920° C. to austenitize a substantial part, preferably at least 60% by volume, of the whole matrix. When held at a temperature lower than 800° C., the austenitization of the substantial part of the whole matrix cannot be attained. The period of time to be held at the above temperature range is 1 to 30 minutes, preferably 1 to 10 minutes, although depends on the austenitizing temperature. The heating rate to the austenitizing temperature is not specifically limited.

(2) Slow cooling

Figure 3:
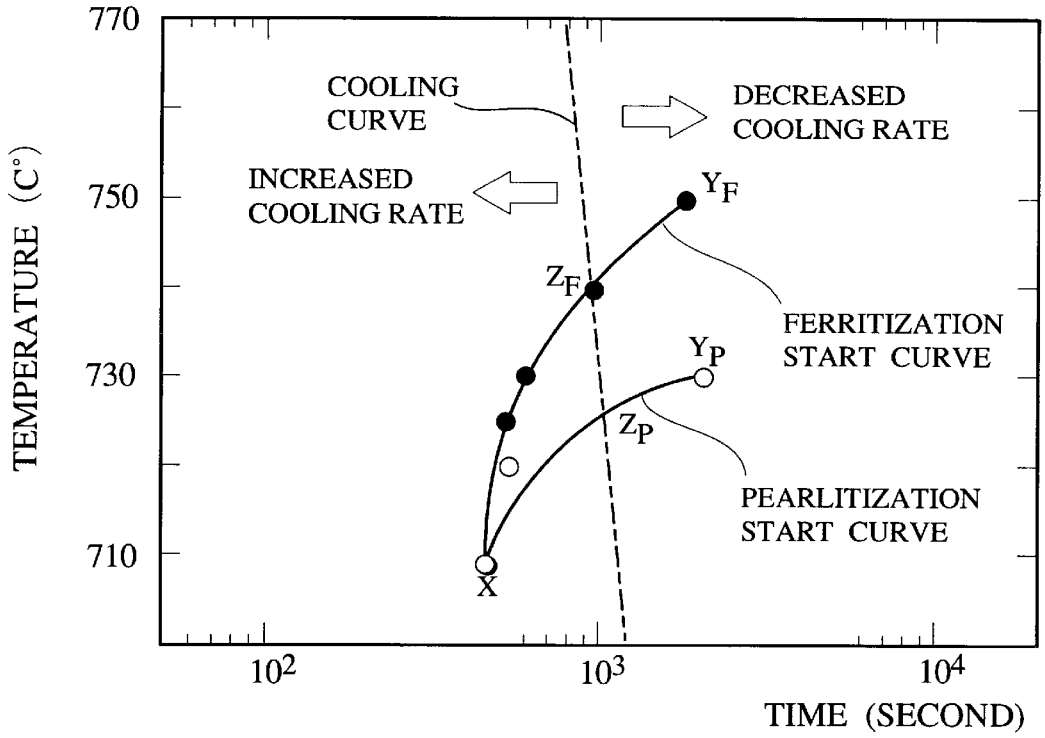
FIG. 3 is a graph illustratively showing CCT curves and a cooling curve in the method of the present invention.

The starting spheroidal graphite cast iron subjected to the austenitizing heat treatment is then slowly cooled at such a cooling rate that the ferritization of the surface layer portion 1 occurs before the pearlitization of the inner portion 2 starts in the subsequent holding step (3). The cooling rate is determined by a continuous cooling transformation diagram (CCT diagram). As shown in FIG. 3, the CCT diagram is obtained by plotting the ferritization start points and the pearlitization start points on a graph paper with the temperature on the vertical axis and the holding time on the horizontal axis. The curve X-$Y_F$ passing through the ferritization start points (ferritization start curve) generally lies to the left (shorter time side) of the curve X-$Y_P$ passing through the pearlitization start points (pearlitization start curve). The extreme left ends (the lowest temperature sides) of both the curves are superposed on each other, and both the curves have the upper limits at the extreme right ends (the highest temperature sides).

The position of the line indicating the cooling rate (cooling curve) is shifted to the left with increasing cooling rate. If the cooling rate is too high and the cooling curve passes through the point X (the point of intersection between the ferritization start curve and the pearlitization start curve), the pearlitization proceeds rapidly and predominantly, and as a result thereof, the ferritization of the surface layer portion hardly occur. When the cooling curve intersects both the ferritization start curve and the pearlitization start curve at the right of the point of intersection X, a shorter distance between the points of intersection $Z_F$ and $Z_P$ produces a thin ferritized surface layer portion because the pearlitization starts in the inner portion before the ferritization proceeds to a sufficient extent enough to form the surface layer portion having a thickness of at least 0.5 mm.

The distance between the points of intersection $Z_F$ and $Z_P$ increases with the shift of the cooling curve to the right. However, when the distance is too large, the ferritized surface layer portion becomes disadvantageously thickened to result in reducing the mechanical strength of the spheroidal graphite cast iron article. When the cooling curve is further shifted to the right to fail to intersect the pearlitization start curve, the pearlitization of the inner portion cannot occur. Therefore, the cooling rate should be suitably selected so as to avoid the disadvantages set forth above. For example, the cooling rate is suitable to be 5° to 20° C./min, preferably 10 to 15° C./min.

(3) Isothermal transformation

Figure 4:
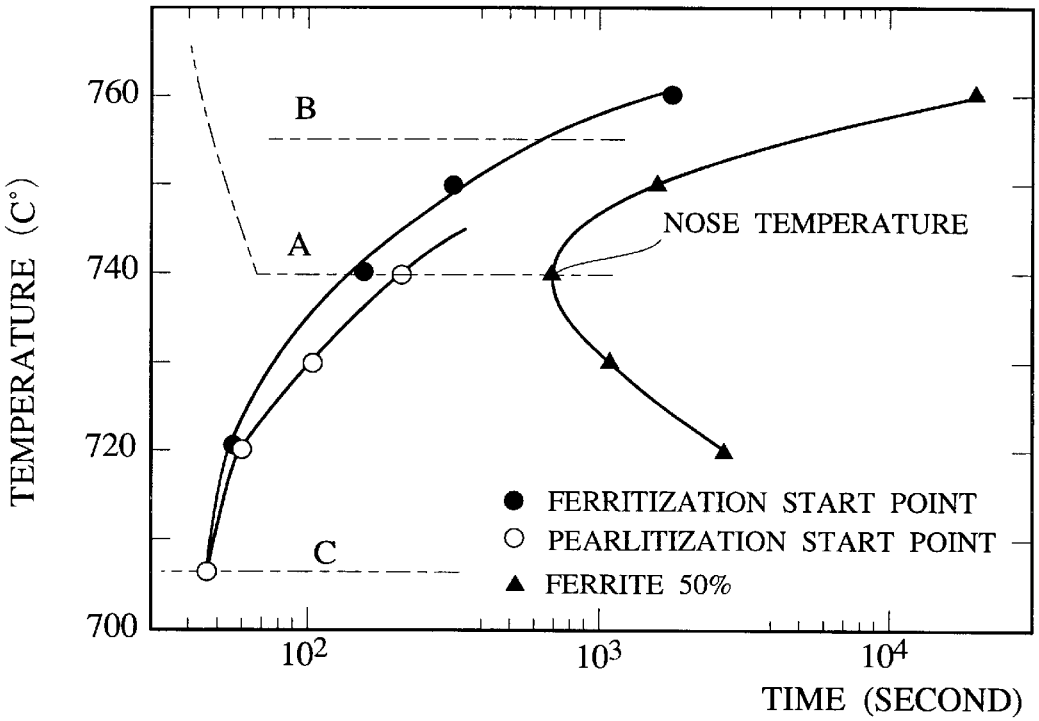
FIG. 4 is a graph illustratively showing TTT curves and a cooling curve in the method of the present invention.

After slowly cooled at a controlled cooling rate as described above, the starting spheroidal graphite cast iron is then held at a temperature range within which the surface layer portion is first ferritized and the inner portion 2 is subsequently pearlitized while preventing the ferrite phase formed in the surface layer portion from being transformed to the other phases. By this treatment, a large part of the matrix of the surface layer portion is ferritized, and a large part of the matrix of the inner portion 2, which is substantially austenitic, is subsequently transformed to pearlite phase. The temperature at which the starting spheroidal graphite cast iron is held for the preceding ferritization of the surface layer portion and the delayed pearlitization of the inner portion may be determined by an isothermal transformation diagram (time temperature transformation diagram, TTT diagram). For example, a TTT diagram in FIG. 4 shows that the nose temperature (about 740° C.) of the 50% ferritization curve is most suitable as the holding temperature.

Immediately after, preferably within about 3 seconds after intersecting the ferritization start curve, the cooling curve A intersects the pearlitization start curve and then passes through the nose temperature of the 50% ferritization curve. Therefore, the cooling curve A creates the optimum heat-treatment conditions for providing the starting spheroidal graphite cast iron with the double layer structure. The cooling curve B does not intersect the pearlitization start curve because the holding temperature is too high, thereby failing to bring about the pearlitization of the inner portion 2. The cooling curve C passes through the point of intersection of the ferritization start curve and the pearlitization start curve because the holding temperature is too low, thereby preventing the ferritization of the surface layer portion.

Taking into account the above, the holding temperature during the isothermal ferritization and the subsequent pearlitization is preferred to be in a range of the nose temperature (740° C.) ±30° C., i.e., 710° to 770° C., more preferably 735° to 745° C. When the holding temperature is lower than 710° C., both the ferritization of the surface layer portion and the pearlitization of the inner portion are insufficient. When the holding temperature is higher than 770° C., the thickness of the ferritized surface layer portion is too large because the retardation of the pearlitization of the inner portion allows the ferritization of the surface layer portion to proceed much more than needed.

Although the holding time depends on the cooling rate of the step (2), it is preferably 5 to 30 minutes, more preferably 10 to 20 minutes. When the holding time is shorter than 5 minutes, the ferritized surface layer portion is thinner than 0.5 mm, and the inner portion is also ferritized due to indirect transformation to lower the pearlitization ratio of the inner portion when the holding time is longer than 30 minutes.

(4) Cooling

The cooling method and the cooling rate to room temperature after the isothermal transformation is not specifically limited, and any of cooling methods such as cooling by standing, air cooling, water cooling, etc. may be employed. However, when the holding time during the isothermal transformation is near the upper limit of the above range, the pearlite phase in the inner portion may be occasionally ferritized due to indirect transformation. Therefore, the starting spheroidal graphite cast iron after the isothermal transformation is preferred to be quenched rapidly immediately after the completion of the pearlitization of the inner portion, preferably by a cooling rate of 3° to 30° C./min, more preferably 5° to 10° C./min by a forced air cooling or other cooling methods.

By subjecting the starting spheroidal graphite cast iron to the above successive heat treatment, the spheroidal graphite cast iron article of the present invention is produced.

[3] Mechanism of forming double layer structure

In the spheroidal graphite cast iron article of the present invention, the ferritizing ratio decreases from the surface layer portion toward the inner portion, and the pearlitizing ratio has the maximum value at a center portion the resulting spheroidal graphite cast iron article. The mechanism of forming such a double layer structure can be presumed as follows. During the slow cooling of the step (2), the outer side of the austenitized starting spheroidal graphite cast iron is cooled at such a cooling rate as to ensure the preceding ferritization of the surface layer portion prior to starting the pearlitization of the inner portion, and the austenite phase of the outer portion is directly transformed to the ferrite phase in the subsequent step where the starting spheroidal graphite cast iron held at a temperature specified above. Since the transformation of austenite of the surface layer portion to ferrite is accompanied by an increase in volume, a three-dimensional tensile stress is generated in the inner portion. The induced tensile stress raises the eutectoid point to promote the pearlitization. Since the pearlitization increases the volume further, the eutectoid point in the inner portion further increases. Thus, the pearlitization proceeds more easily in the inner portion. In addition, the tensile stress in the inner portion depends on the ferritizing ratio of the surface layer portion, the more the surface layer portion is ferritized, the more efficiently promoted the pearlitization of the inner portion is.

The present invention will be further described while referring to the following Examples which should be considered to illustrate various preferred embodiments of the present invention.

EXAMPLE 1

(Austenitizing Temperature)

The influence of the austenitizing temperature was evaluated as follows. A material having a composition of Table 1 was melt in a 100-kg induction furnace, and a spheroidal graphite cast iron having a 30 diameter of 30 mm and a length of 30 mm was produced by a sand-mold casting method. The as-cast spheroidal graphite cast iron has a bull's eye structure and about 90% by volume fraction of the matrix thereof was pearlite. The casting surface of the cast product was removed to obtain test pieces having a diameter of 25 mm and a length of 30 mm.

TABLE 1

| (weight %) | | | | | | | | |
|---|---|---|---|---|---|---|---|---|
| C | Si | P | S | Mg | Cu | Mn | Cr | Fe and impurities |
| 3.63 | 2.25 | 0.02 | 0.01 | 0.04 | 0.40 | 0.40 | 0.02 | balance |

Figure 2:
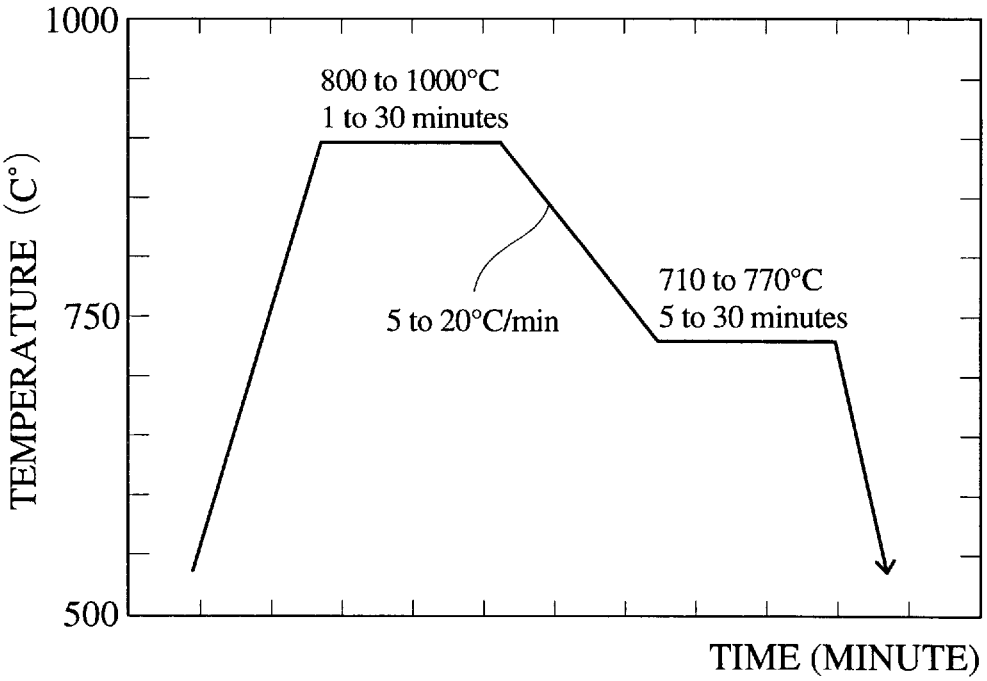
FIG. 2 is a graph showing a heat treatment cycle employed in the present invention.

According to the heat treatment pattern shown in FIG. 2, each of the test pieces was subjected to the austenitizing treatment by being held at 850° C., 900° C. or 950° C. for 5 minutes, 10 minutes or 30 minutes. After the austenitizing treatment, the test pieces were cooled at a cooling rate of 15° C./min to 740° C., held at 740° C. for 20 minutes, and then air-cooled to room temperature.

Figure 5:
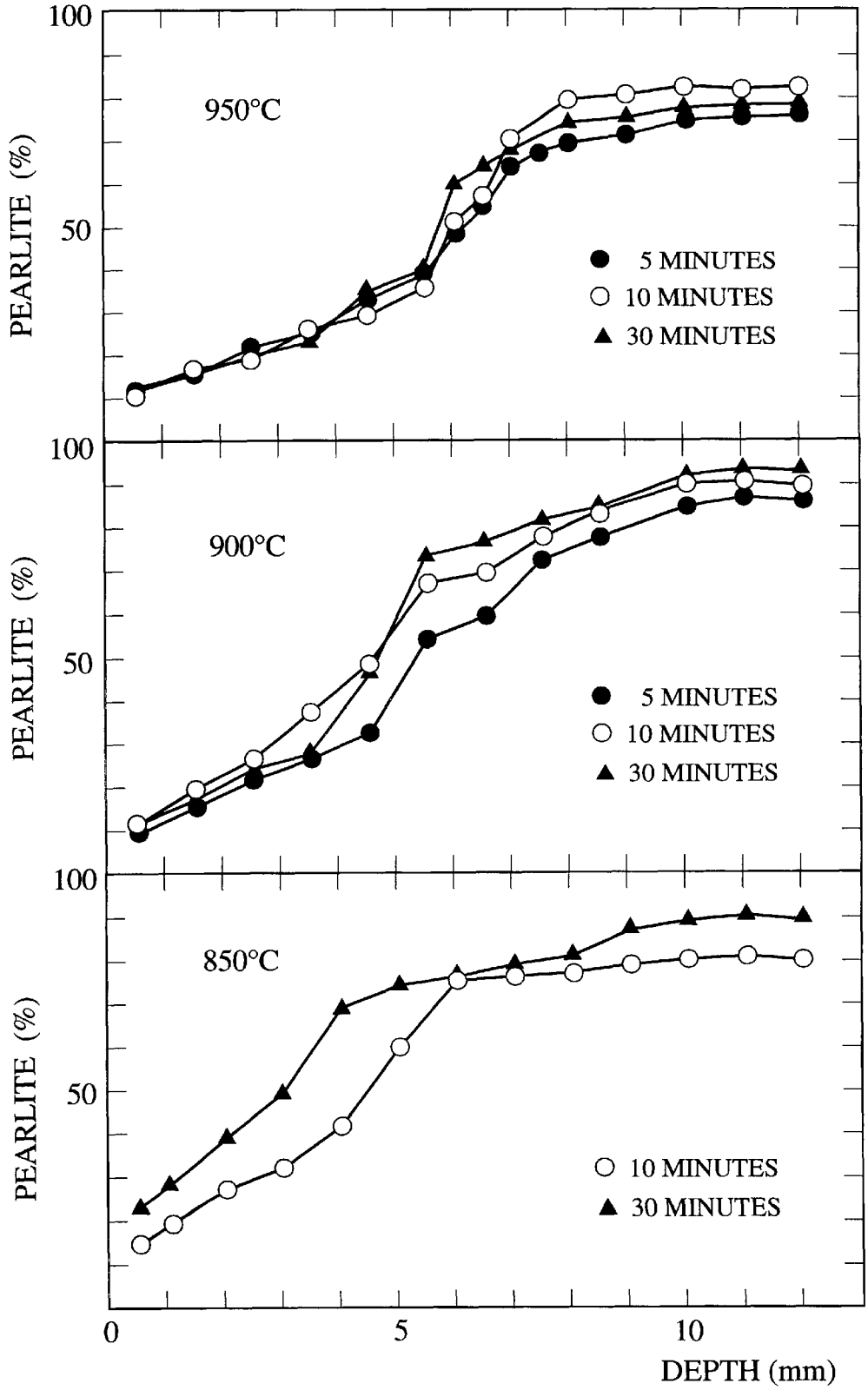
FIG. 5 is a graph showing variation of a pearlitization ratio with a depth from a surface of the spheroidal graphite cast iron articles of Example 1 subjected to austenitization at different temperatures and different periods of time.

The distribution of pearlite phase in the depth direction of each heat-treated test piece was measured. The results are shown in FIG. 5. In FIG. 5, the pearlitization ratio by volume fraction in respective depth was given and the residual portion of the matrix was substantially the ferrite phase. FIG. 5 shows that there is a considerable difference in the ferritization ratio between the surface layer portion and the inner portion. It can been seen that the thickness of the surface layer portion having a ferritization ratio of 60% or more increases with increasing austenitizing temperature. For example, when the austenitizing time was 10 minutes, the thickness was about 3.8 mm for 850° C., about 3.8 mm for 900° C., and 5.6 mm for 950° C. Thus, it has been confirmed that the thickness of the surface layer portion having a ferritization ratio of 60% or more can be controlled by changing the austenitizing temperature.

The pearlitization ratio of the inner portion was nearly the same between the austenitizing temperatures of 950° C. and 850° C., and the heat treatment at 900° C. gave the highest pearlitization ratio. Thus, it has been confirmed that the optimum austenitizing temperature is around 900° C.

EXAMPLE 2

(Holding Temperature)

The influence of the holding temperature in the isothermal transformation step was evaluated as follows. The same test pieces as in Example 1 were subjected to the austenitization treatment by being held at 900° C. for 5 minutes for the austenitizing heat treatment, cooled at a cooling rate of 15° C./min to 710° C., 730° C., 740° C. or 750° C., held at each temperature for 5 minutes, and then quenched to room temperature. The distribution of each of ferrite phase, pearlite phase and austenite phase in the depth direction of each heat-treated test piece was measured. The results are shown in FIG. 6.

Figure 6:
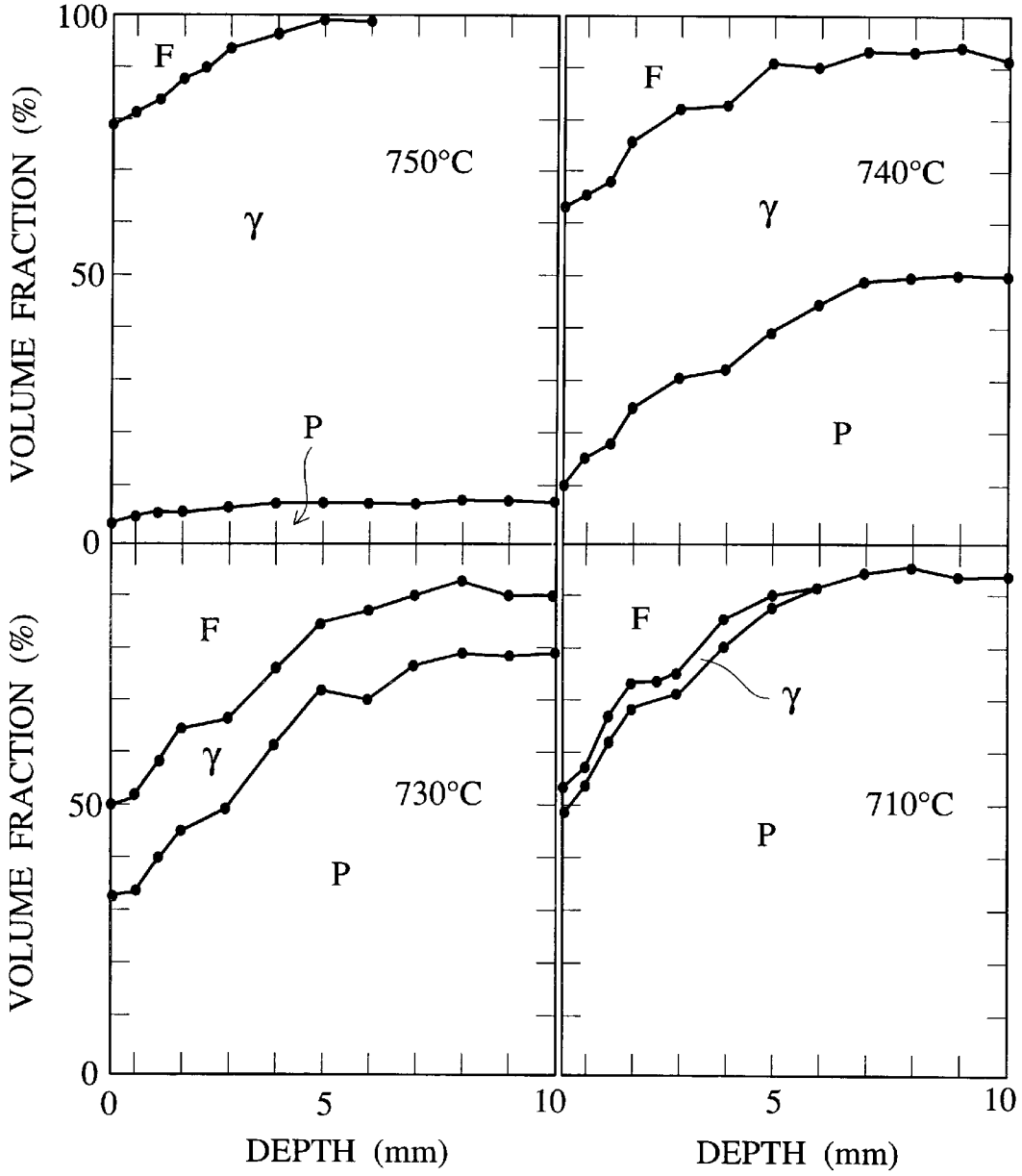
FIG. 6 is a graph showing a variation of a volume fraction of each phase with a depth from a surface of the spheroidal graphite cast iron articles of Example 2 subjected to pearlitization at different temperatures.

As seen from FIG. 6, the austenite phase was retained in any of the test pieces thus treated. When held at 750° C., the ferrite phase was present only in the surface layer portion and the vicinity thereof, and the pearlite phase distribution was not practically different between the surface layer portion and the inner portion. When held at 740° C., the amount of the austenite phase in the inner portion was abruptly reduced as compared when held at 750° C., whereas the amount of the pearlite phase considerably increased. This tendency was more remarkable as the holding temperature was lowered to 730° C. and 710° C. This results show that the holding temperature for the ferritization of the surface layer portion is preferable to be within the eutectoid temperature region, i.e., 730° C. to 750° C. When held at 740° C., the ferritization was not completed in the holding time of 5 minutes. In this case, the ferritizing ratio of the surface layer portion may increase by extending the holding time. The double layer structure becomes difficult to be achieved when the holding temperature is lower than 710° C., because the pearlitization rate is so high that the ferritization of the surface layer portion cannot sufficiently proceed.

EXAMPLE 3

(Holding Time)

The influence of the holding time in the isothermal transformation step was evaluated as follows. The same test pieces as in Example 1 were subjected to the austenitization treatment by being held at 900° C. for 5 minutes, cooled at a cooling rate of 15° C./min to 735° C., held there for 1 minute, 2 minutes, 3 minutes or 10 minutes, and then water-cooled to room temperature. The distribution of each of ferrite phase, pearlite phase and austenite phase in the depth direction was measured on each test piece thus heat-treated. The results are shown in FIG. 7.

Figure 7:
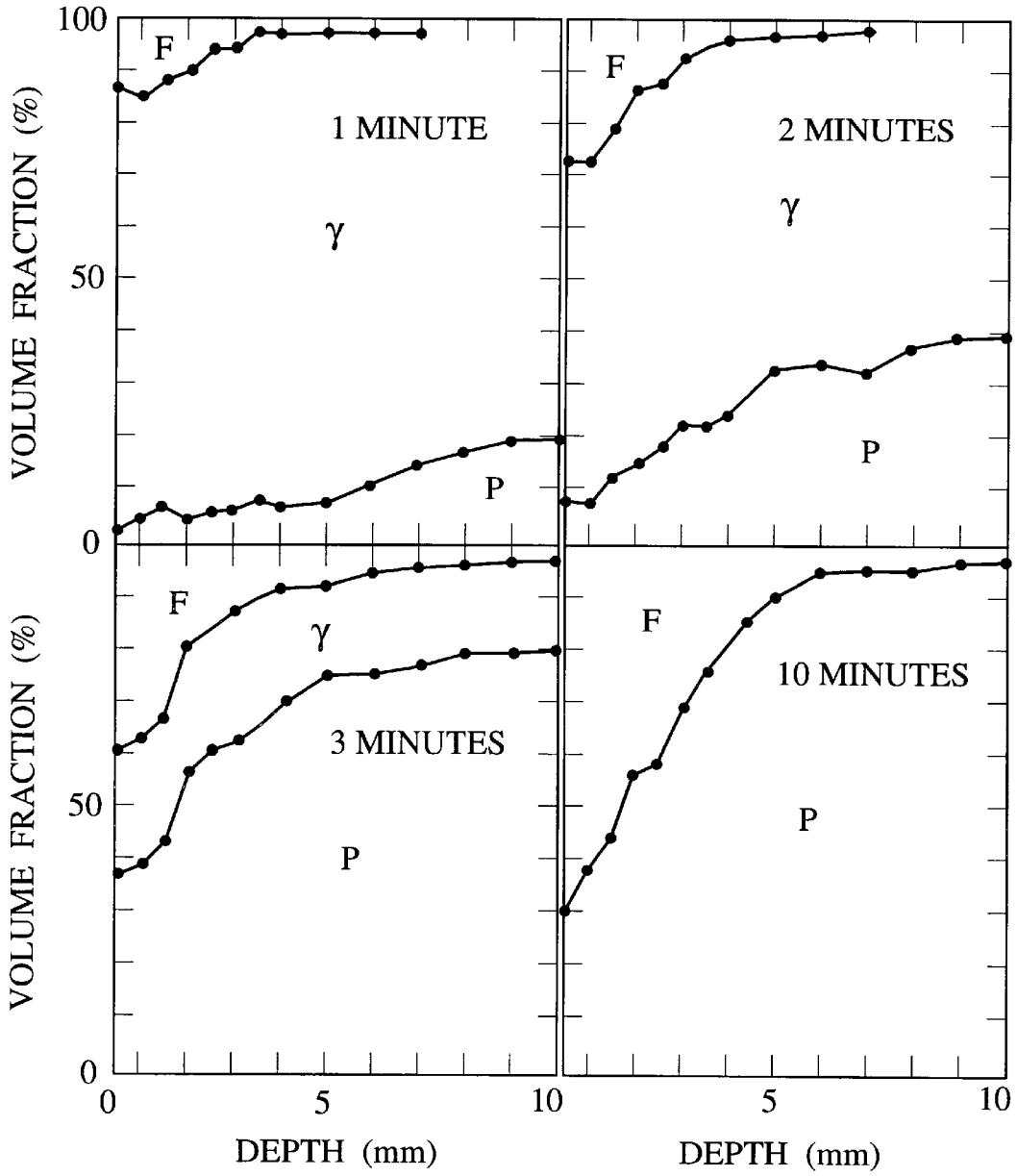
FIG. 7 is a graph showing a variation of a volume fraction of phases with a depth from a surface of the spheroidal graphite cast iron articles of Example 3 subjected to pearlitization at different periods of time.

As seen from FIG. 7, the ferritization ratio and pearlitization ratio of the surface layer portion were about 10% and about 56%, respectively, when held for 1 minute. There was no appreciable difference in the austenite content between the surface layer portion and the inner portion.

The ferritization ratio of the surface layer portion gradually increased with increasing holding time. However, the ferritization ratio of the inner portion was practically independent of the holding time. When held for 10 minutes, the ferritization ratio was about 70% at the surface layer portion, about 5% in the inner portion and the difference between them was about 65%. These results show that the holding time is preferably 10 minutes or longer, more preferably 10 to 20 minutes when the holding temperature is 735° C. The holding time is preferred to be prolonged with decreasing holding temperature, and usually 5 to 30 minutes, preferably 10 to 20 minutes for the holding temperature range of 710 to 770° C. The pearlitization ratio of the surface layer portion did not change pronouncedly with increasing holding time, whereas increased remarkably toward the inner portion, in particular, when the holding time was 5 minutes or longer. This is because that the ferritization of the surface layer portion creates the tensile stress in the inner portion to raise the eutectoid point, this promoting the pearlitization of the inner portion.

EXAMPLE 4

(TTT Diagram)

Figure 8:
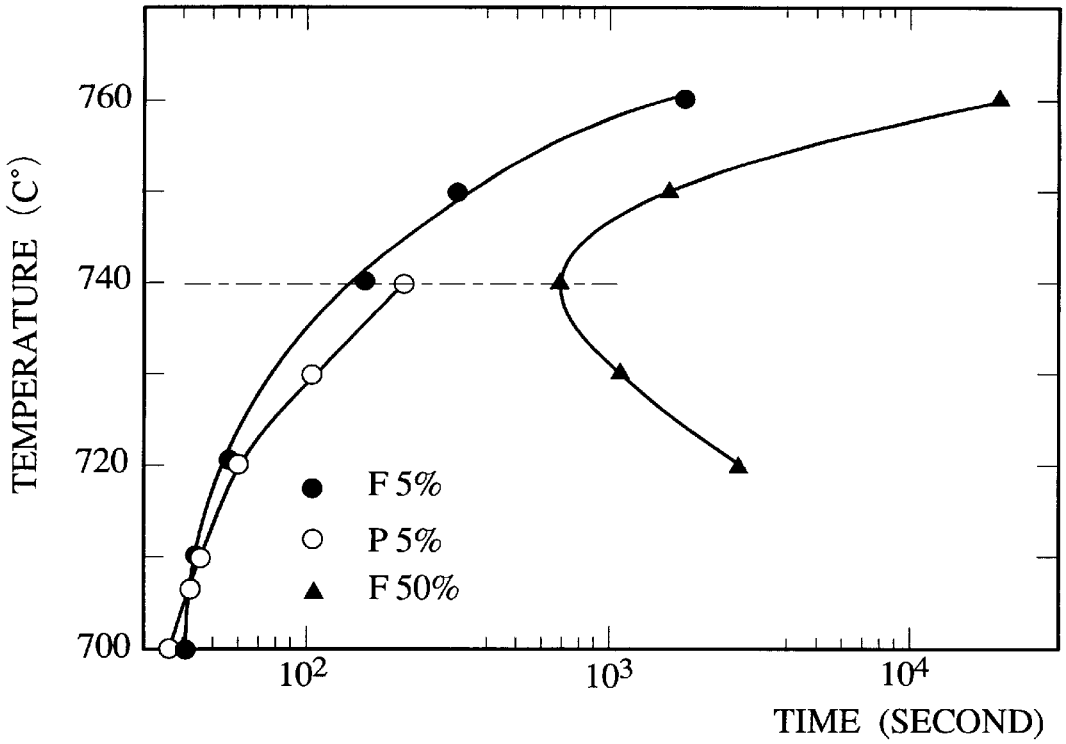
FIG. 8 is a graph illustratively showing TTT curves and a cooling curve obtained in Example 4.

Test pieces (6 mm×6 mm×10 mm) having the same alloy composition as in Example 1 were subjected to the austenitization treatment by being held at 900° C. for 10 minutes, and then immersed in an aluminum melt to be held at a transformation temperature T (720° C., 730° C., 740° C., 750° C. or 760° C.) for 1 to 640 minutes. The amount of each of austenite phase, ferrite phase and pearlite phase was measured on each test pieces thus treated. Based on the results, a TTT diagram shown in FIG. 8 was drew. In FIG. 8, the F5% curve indicating the points at which the ferritization ratio is 5% is substantially the same as the ferritization start curve. Also, the P5% curve indicating the points at which the pearlitization ratio is 5% is substantially the same as the pearlitization start curve. The F50% curve indicates the points at which the ferritization ratio reaches 50%.

As seen from FIG. 8, the nose temperature of the ferritization is about 740° C. At a temperature lower than 710° C., the ferritization start curve and the pearlitization start curve closely approach each other. This shows that the surface layer portion is hardly ferritized when held at a temperature lower than 710° C.

EXAMPLE 5

(CCT Diagram)

Test pieces (6 mm×6 mm×10 mm) having the same alloy composition as in Example 1 were subjected to the austenitization treatment by being held at 900° C. for 10 minutes, and then cooled at a constant cooling rate (5° C./min, 10° C./min, 20° C./min) to a transformation temperature (710° C., 720° C., 730° C., 740° C. or 750° C.). When reached the transformation temperature, each test piece was quenched rapidly in water. The metal structure of each test piece was examined to determine the ferritization start point and the pearlitization start point, and based on the results, a CCT diagram shown in FIG. 9 was drawn.

Figure 9:
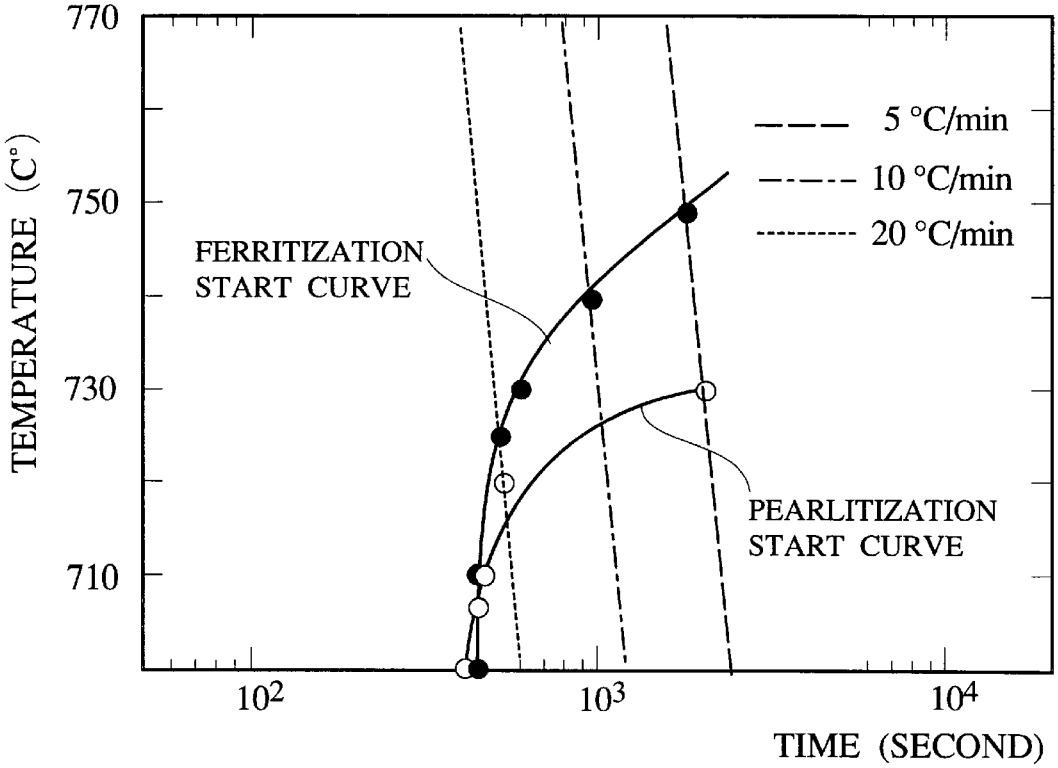
FIG. 9 is a graph illustratively showing CCT curves and cooling curves obtained in Example 5.

FIG. 9 shows a region in which both the ferritization start curve and the pearlitization start curve exist. When cooled at a cooling rate of 20° C./min, the distance between the points of intersection, at which the cooling curve (represented by broken line) intersects both the ferritization start curve and the pearlitization start curve, was relatively narrow.

However, when cooled at a cooling rate of 5° C./min, the distance was broad. This indicates that the lower limit for the cooling rate is 5° C./min.

EXAMPLE 6

(Thermal Expansion Test)

A test piece (4 mm×4 mm×13 mm) having the same alloy composition as in Example 1 was subjected to the austenitization treatment by being heated at a constant heating rate of 10° C./min to 900° C. and held there for 10 minutes, and then cooled at a constant cooling rate of 10° C./min. During the heating and cooling, the expansion and contraction in the longitudinal direction of the test piece was measured. The results are shown in FIG. 10.

Figure 10:
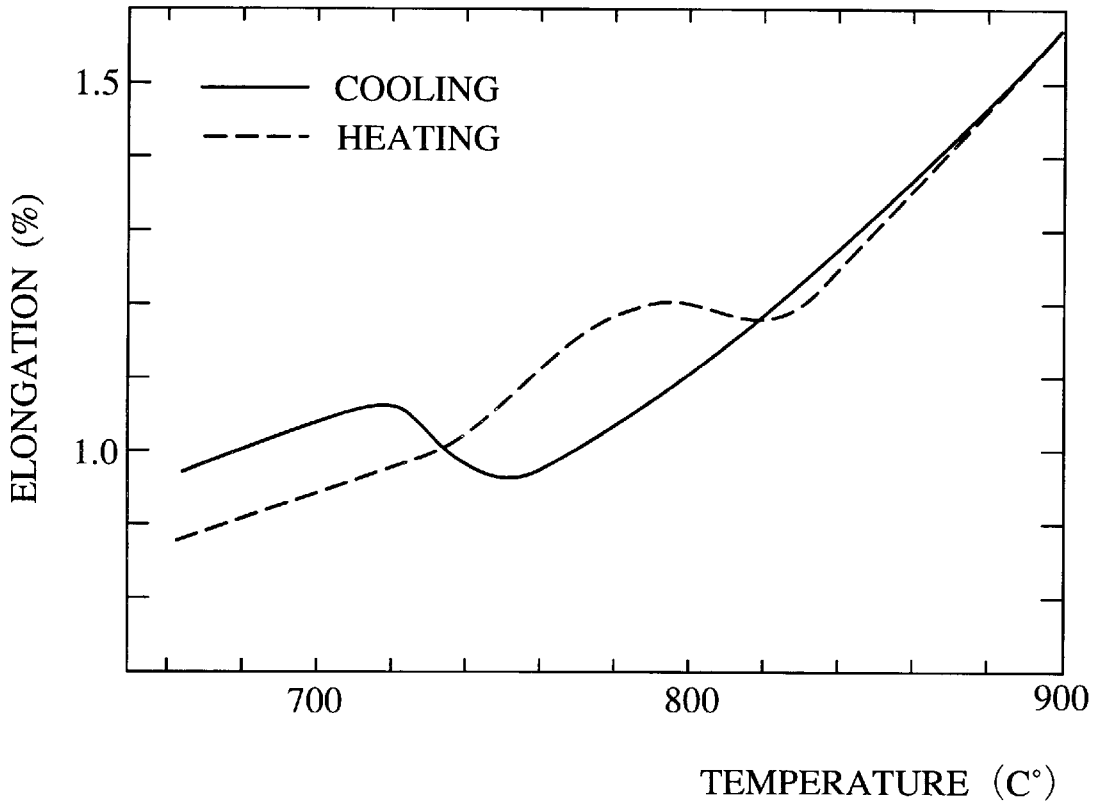
FIG. 10 is a graph showing elongation of the spheroidal graphite cast iron article heated and cooled as in Example 6.

As seen from FIG. 10, a contraction of the test piece due to $A_{c1}$ transformation (austenitization) was observed around 790° C. during the heating. During the cooling, the expansion due to ferritization started when cooled to about 740° C. Examination of the metal structure of the test piece before cooled to 730° C. showed that substantially all the matrix was occupied by ferrite and martensite. Therefore, the expansion observed until the test piece is cooled to 730° C. may be attributed to the ferritization. During the cooling from 720° C. to 700° C., austenite was transformed to pearlite to exhibit the maximum expansion.

EXAMPLE 7

(Measurement of Mechanical Strength)

Figure 11:
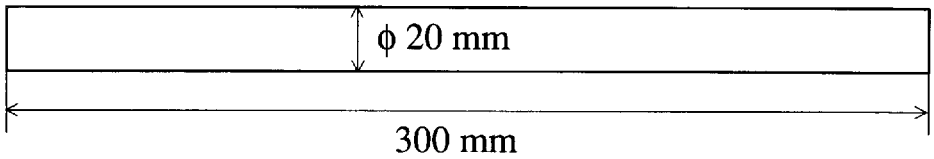
FIG. 11 is a schematic view showing a test specimen used in the bending test of Example 7.

Spheroidal graphite cast iron having the same alloy composition as in Example 1 were ground to produce test pieces for bending test (FIG. 11). According to the heat treatment pattern shown in FIG. 2, each test piece was subjected to the austenitizing heat treatment by being held at 900° C. or 950° C. for 5 minutes, cooled at a cooling rate of 10° C./min to 730° C., held there for 5 minutes, and air-cooled to room temperature. The thickness of the surface layer portion having a ferritizing ratio of 70% or more of the test pieces was 1.3 mm when held at 900° C., and 2.2 mm when held at 950° C. After the heat treatment, the surface of each test piece was ground to remove the oxidized layer.

Figure 12:
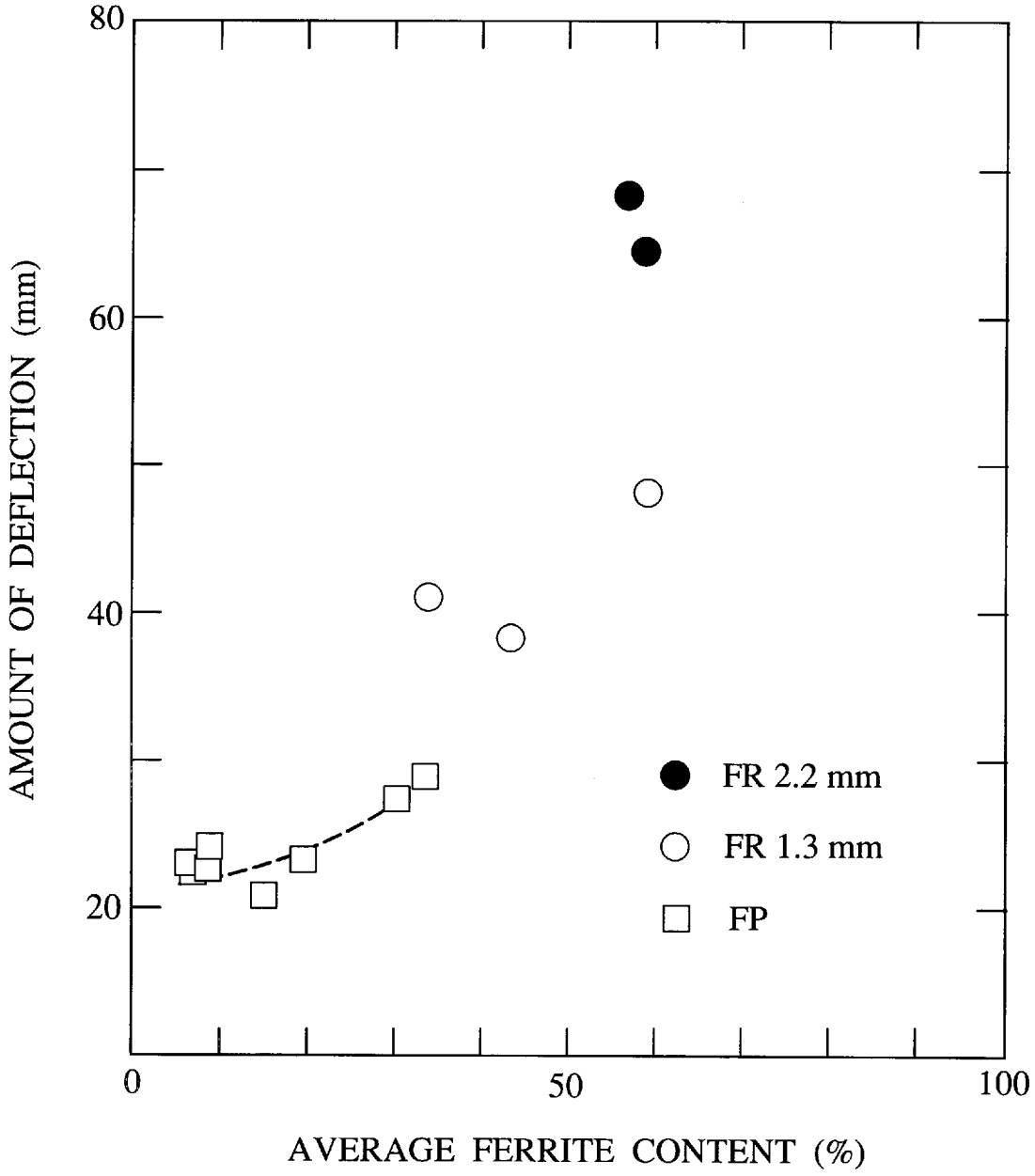
FIG. 12 is a graph showing the correlation between the deflection in the bending test and the average ferritization ratio obtained in Example 7.

The bending test was carried out by applying a load of 40 kgf/cm$^2$ to each test piece, while supported by two supports spaced 250 mm apart, at the midpoint between the supports, and measuring the amount of deflection. For comparison, an as-cast spheroidal graphite cast iron (ferrite-pearlite mixed matrix) having the same alloy composition, which was not heat-treated, was subjected to the same bending test. The results are shown in FIG. 12 in which FR 1.3 mm indicates the test piece having a ferritized surface layer portion of 1.3 mm thick, and FR 2.2 mm indicates the test piece having a ferritized surface layer portion of 2.2 mm thick. Also, FP indicates the comparative test piece having a ferrite-pearlite mixed matrix with no appreciable surface layer portion. The horizontal axis indicates an average ferrite content in the total matrix of each test piece. FIG. 12 shows that the thicker the ferritized surface layer portion is, the more excellent in the bending characteristics (flexibility) the spheroidal graphite cast iron article is.

Figure 13:
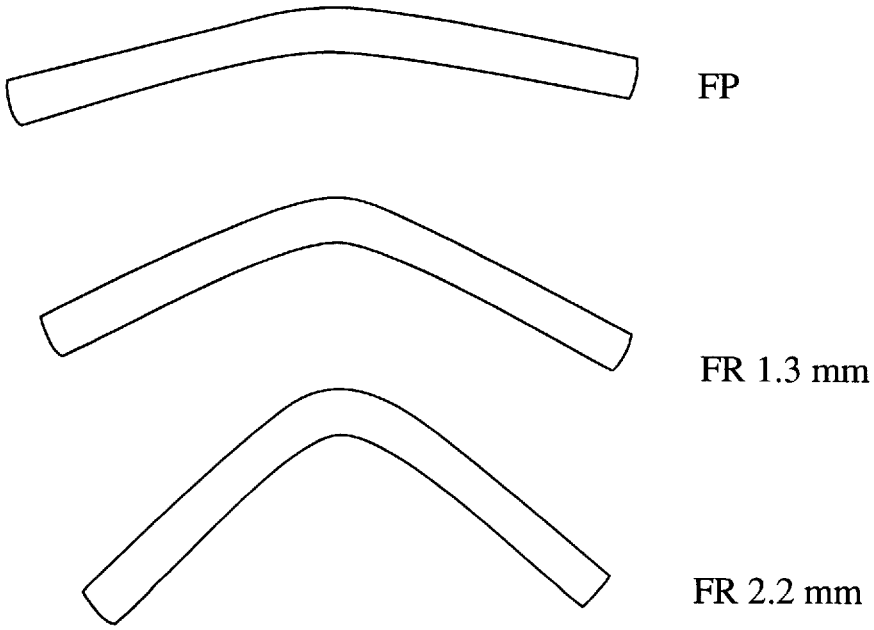
FIG. 13 is a schematic view showing the shapes at break of the test specimens in the bending test of Example 7.

The same test pieces as above were applied a bending load in the same manner as above, and the load was increased until each test piece was broken. The deflected shape at break of each test piece is shown in FIG. 13. It can be seen from FIG. 13 that the test piece having the ferritized surface layer portion can bend without break much more than the comparative test piece having a uniform structure. Also, the maximum deflection amount before break increases with increasing thickness of the ferritized surface layer portion.

Figure 14:
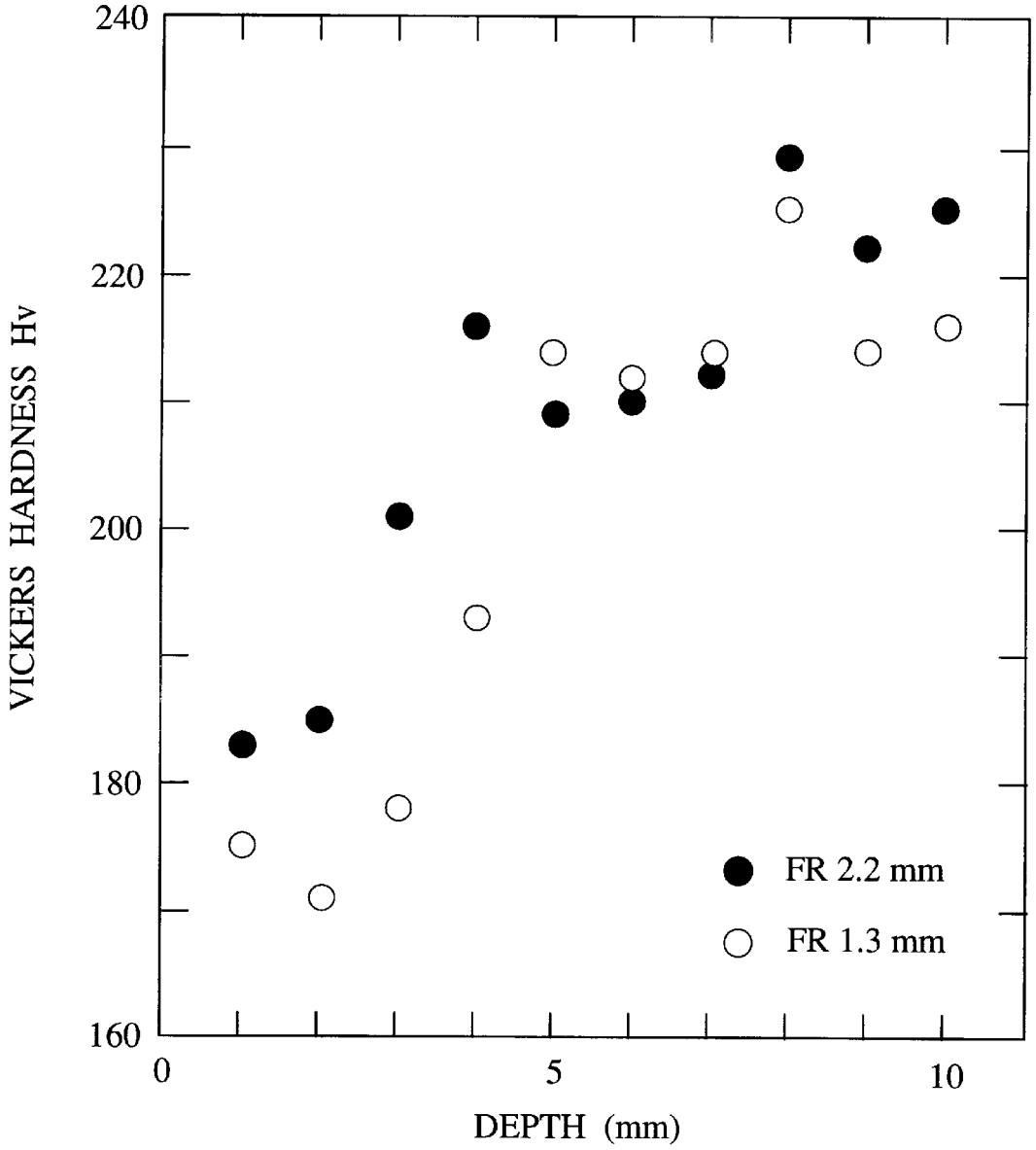
FIG. 14 is a graph showing a correlation between the hardness and the depth from the surface of the test specimens of Example 7.

The hardness (Vickers hardness) variation from the surface to the inner portion was measured on the test pieces (FR 1.3 mm and FR 2.2 mm). The results are shown in FIG. 14. FIG. 14 shows that the surface layer portion is soft, but the hardness abruptly increases at about 3.5 mm from the surface and further increases toward the inner portion. Since the ferrite phase is softer than the pearlite phase, FIG. 14 well demonstrates that the surface layer portion is ferritized and the inner portion is pearlitized in the test pieces FR 1.3 mm and FR 2.2 mm.

As described above, a spheroidal graphite cast iron article having a double layer structure comprising a surface layer portion where 60% or more of the matrix is ferrite phase and a inner portion where a substantial portion of the matrix is pearlite is produced by slowly cooling an austenitized spheroidal graphite cast iron at a controlled cooling rate and then holding the cooled spheroidal graphite cast iron at a specific temperature which allows the surface layer portion to be ferritized before the inner portion starts to be pearlitized. Since the method of the present invention utilize a combination of a slow cooling and an isothermal transformation (ferritization and pearlitization), each step can be easily and strictly controlled to stabilize the quality of the products and reduce the production cost.

As described above in detail, since the spheroidal graphite cast iron article of the present invention has a surface layer portion having a slightly decreased hardness and an inner portion having a high mechanical strength, it shows improved bending characteristics and impact strength as well as an excellent mechanical strength as a whole. The spheroidal graphite cast iron article of the present invention is suitable for parts required to have good strength and toughness and likely to be used without removing casting surfaces, for instance, parts for suspension parts of automobiles, joints for connecting steel reinforcements, base members for fixing steel columns of buildings, etc.

What is claimed is:

1. A method of producing a spheroidal graphite cast iron article containing at least one pearlite stabilizing element selected from the group consisting of Mn, Cu, Sn, Sb and Pb and having a double layer structure which comprises a surface layer portion and an inner portion, said surface layer portion having a matrix having a ferritization ratio of 60% or more and a thickness of at least 0.5 mm and said inner portion having a matrix substantially comprising pearlite phase, which method comprises:

(1) heat-treating a starting spheroidal graphite cast iron at a temperature which transforms a whole part of a matrix of said starting spheroidal graphite cast iron substantially to austenite phase;

(2) slowly cooling the austenitized spheroidal graphite cast iron at a cooling rate which allows in a subsequent step the surface layer portion to be ferritized before the inner portion starts to be pearlitized, wherein said cooling rate is 5° to 20° C./min;

(3) holding the cooled spheroidal graphite cast iron at a temperature which allows the surface layer portion to be first ferritized and subsequently allows the inner portion to be pearlitized while preventing the ferrite phase of the surface layer portion from being transformed to the other phases; and (4) cooling the spheroidal graphite cast iron thus transformed immediately after completion of said pearlitization of the inner portion.

2. The method according to claim 1, wherein said spheroidal graphite cast iron article has an alloy composition comprising 3.4 to 3.9% of C, 1.9 to 2.6% of Si, 0.055 or less of P, 0.02% or less of S, 0.02 to 0.06% of Mg, 0.001 to 0.8% of said at least one pearlite stabilizing element, and a balance of Fe and inevitable impurities.

3. The method according to claim 1, wherein said heat treatment for austenitization is carried out at 800° to 1000° C. for 1 to 30 minutes.

4. The method according to claim 1, wherein said ferritization of the surface layer portion and said subsequent pearlitization of the inner portion is carried out at 710° to 770° C. for 5 to 30 minutes.

5. The method according to claim 1, wherein said spheroidal graphite cast iron after completion of said pearlitization is rapidly quenched.

6. The method according to claim 2, wherein said heat treatment for austenitization is carried out at 800° to 1000° C. for 1 to 30 minutes.

7. The method according to claim 2, wherein said ferritization of the surface layer portion and said subsequent pearlitization of the inner portion is carried out at 710° to 770° C. for 5 to 30 minutes.

8. The method according to claim 2, wherein said spheroidal graphite cast iron after completion of said pearlitization is rapidly quenched.

* * * * *